US005937684A

United States Patent [19]

Long

[11] Patent Number: 5,937,684

[45] Date of Patent: Aug. 17, 1999

[54] TAP EMPLOYING DEFORMATION OF MATTER

[75] Inventor: Jean-François Long, Thyez, France

[73] Assignee: Ademva, Thyez, France

[21] Appl. No.: 08/936,551

[22] Filed: Sep. 24, 1997

[51] Int. Cl.[6] ..... B21H 3/08

[52] U.S. Cl. ..... 72/118; 72/126

[58] Field of Search ..... 72/104, 118, 119, 72/126, 103, 117, 122, 123

[56] References Cited

U.S. PATENT DOCUMENTS

| | | | |
|---|---|---|---|
| 223,840 | 1/1880 | Collins | 72/123 |
| 559,189 | 4/1896 | Mosher | 72/126 |
| 785,982 | 3/1905 | Kinney | 72/126 |
| 949,136 | 2/1910 | Ashley | 72/123 |
| 2,349,863 | 5/1944 | Hallberg | 72/126 |
| 2,645,954 | 7/1953 | Pfingston | 72/118 |
| 3,491,567 | 1/1970 | Zeller et al. | 72/118 |

*Primary Examiner*—Lowell A. Larson
*Attorney, Agent, or Firm*—Browdy and Neimark

[57] ABSTRACT

This invention relates to a tap employing deformation of matter, wherein it comprises a body which bears three rotating cylinders mounted idly and provided with annular threads each distant by the value of the pitch of the threading to be made. These three cylinders are regularly distributed and are inclined axially by an angle equal to the helix angle of the thread to be made.

4 Claims, 2 Drawing Sheets

TAP EMPLOYING DEFORMATION OF MATTER

FIELD OF THE INVENTION

The present invention relates to a tap, i.e. to a tool for making a threading inside a hole of circular cylindrical section, previously made in a piece which is generally metallic, but which may be made of any other material.

BACKGROUND OF THE INVENTION

In its most widespread form, a tap is a tool whose periphery is threaded in interrupted manner, thus defining cutters which act by removing matter and more particularly by removing turnings.

This method of tapping by removal of turnings presents drawbacks due to its basic design, as the removal of turnings cuts the fibers of the metal and results in threads whose resistance is often judged insufficient.

This is why another form of tapping is currently preferred, which acts by deformation of matter, therefore without prohibitively injuring the metal.

Taps are in that case taps of polygonal section. When the tap rotatingly penetrates in the hole to be tapped, it is the apices of the polygon which deform the matter in order to produce the desired threading.

The process of tapping by deformation is therefore considered at the present time as the only process valid for obtaining threads which are highly resistant and therefore reliable and long-lasting.

Presently known taps employing deformation, i.e. taps of polygonal section, are subjected, when they act to deform the matter, to great friction generated by the considerable efforts which necessarily come into play. This results in considerable heating and wear of the tap and consequently a relatively short life therefor.

In addition, the work speeds of these taps are necessarily relatively slow, which penalizes industrial productivity when these taps are intended to equip automatic tappers such as the one described in document EP-A-0 192 586 in the name of the Applicants.

It is an object of the present invention to overcome these drawbacks of the taps acting by deformation as presently used in the state of the art.

SUMMARY OF THE INVENTION

To that end, the present invention relates to a tap for making, by deformation of matter, a helicoidal threading inside a hole with smooth walls and of uniformly circularly section, this tap comprising a rigid body whose radial dimensions are smaller than those of the hole to be tapped, and which serves as support for a plurality of smaller peripheral rotating cylinders, of the same diameter, which are regularly spaced apart and mounted idly in respective peripheral receiving cavities in this rigid body, where they rest by their two respective shaft ends, each of these rotating cylinders being provided with sharp annular threads, these threads therefore not being spiral but purely circular and being separated from one another by a distance equal to the pitch of the threading to be made, these annular threads being coaxial and of common axis inclined, with respect to the axis of the tap, by an angle equal to the helix angle of the threading to be produced, each of these cylinders projecting sufficiently from the peripheral surface of said rigid body to fill at that spot the tubular space remaining between said rigid body, positioned coaxially to the hole to be tapped, and the threading to be made, these cylinders all being identical, except for their two respective shaft ends which are respectively adjusted so that the first annular thread, or leading thread, of the second cylinder is offset axially with respect to that of the first cylinder, or leading cylinder, by a fraction of pitch equal to the number of cylinders, or by an "Nth" of pitch if the tap comprises N cylinders and so on, from one cylinder to the following up to the last, or Nth, cylinder of the periphery.

The edges of the first annular threads of each cylinder are advantageously at a distance from the axis of the cylinder which is less than that necessary for making the desired threading, the edge of the first annular thread or leading thread in that case being at a distance from this axis which is just sufficient to ensure centering of the tap in the hole to be tapped, while the following thread or threads are at respective distances from this axis which increase progressively until the one necessary for effectively making said threading is arrived at.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
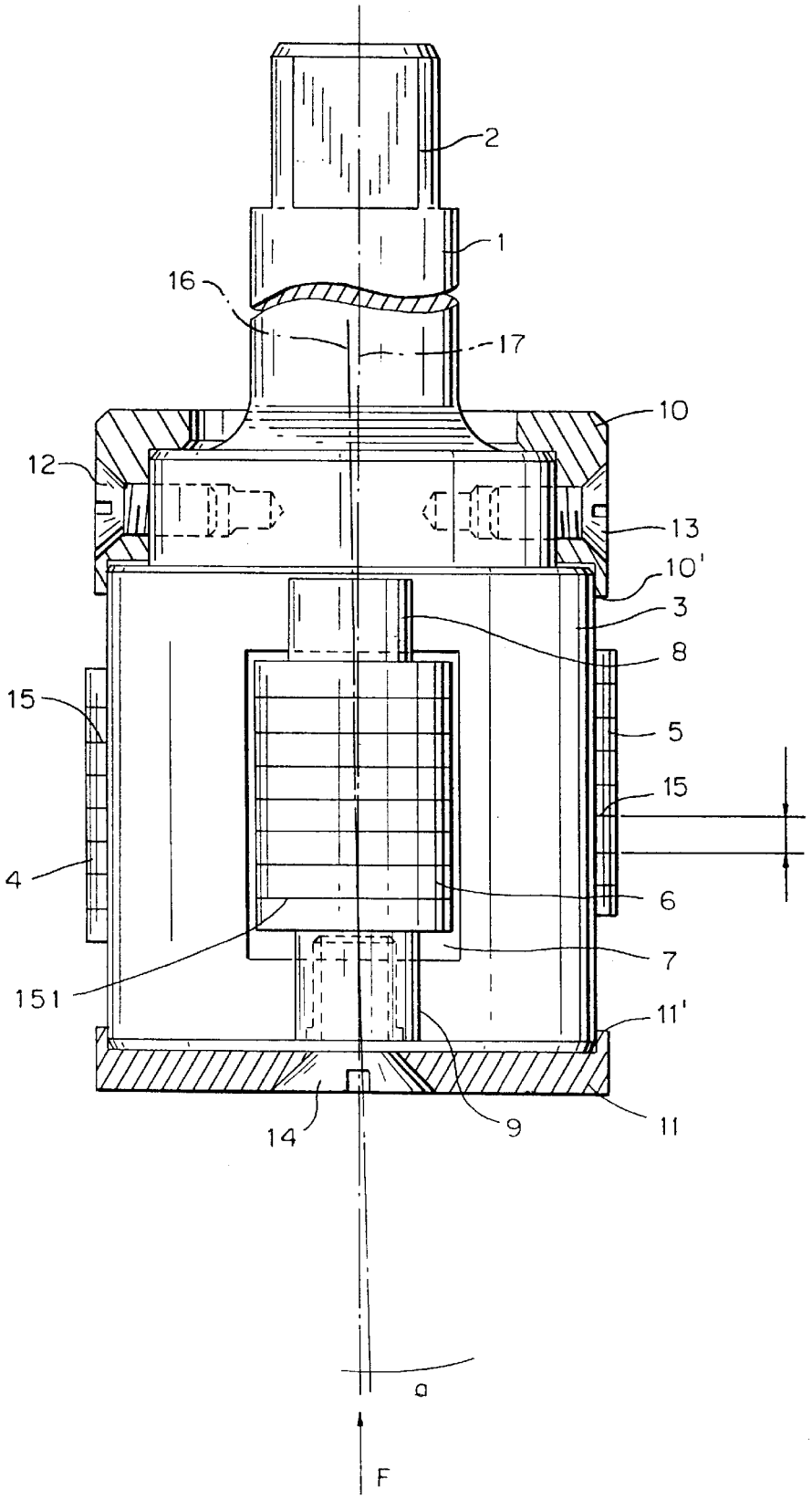
FIG. 1 is an overall view, with partial section, of the tap according to the invention employing deformation of matter.
Figure 2:
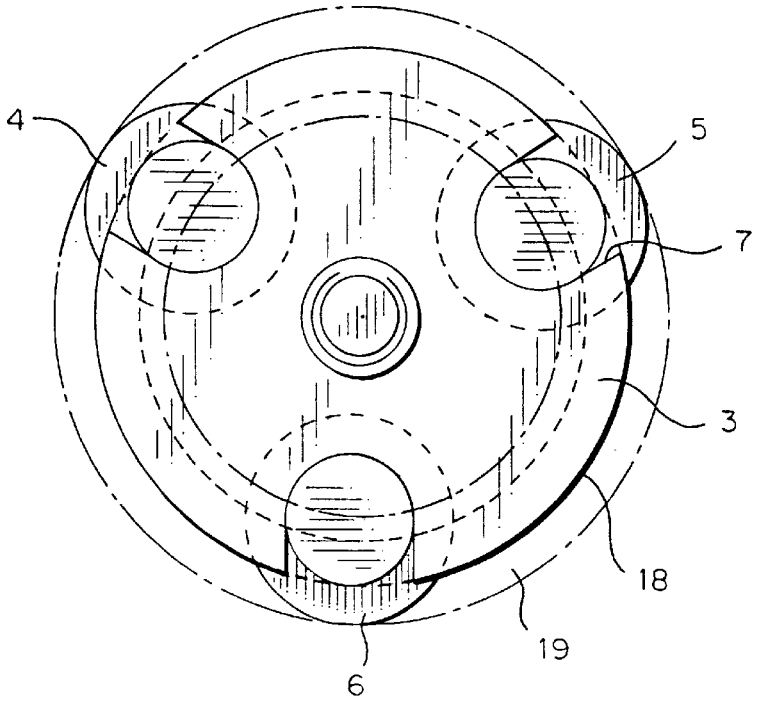
FIG. 2 is an end view, in the direction of F of FIG. 1, with the lower cover removed.
Figure 3:
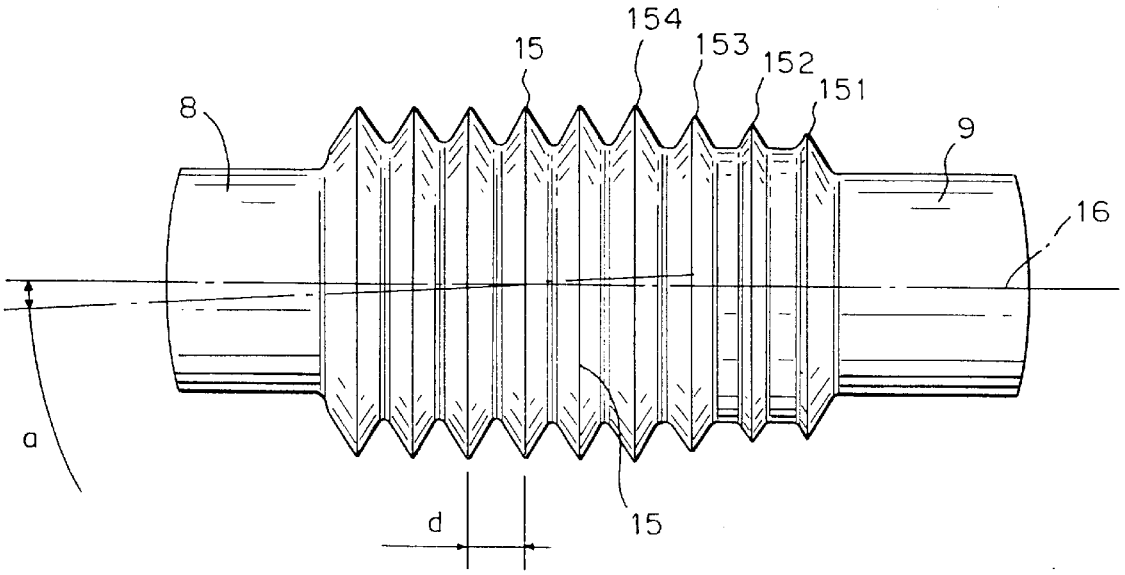
FIG. 3 shows one of the three active cylinders equipping the tap of FIG. 1.

Referring now to the drawings, FIGS. 1 to 3 show a tap comprising a massive metal, cylindrical rod 1 of which one free end 2 is shaped as an end piece of square section and of which the other free end widens to form a massive cylindrical body 3, of cylindrical section. The diameter of the massive body 3 is for example about 2 to 3 times larger than that of the rod 1.

This diameter is in the present case of the order of 25 millimeters. In any case, it is slightly smaller, by about 1 to 2 millimeters, than the diameter of the hole to be tapped.

The massive cylinder 3 serves as support for three smaller peripheral rotating metal cylinders 4, 5, 6 which are regularly distributed over the circumference of the body 3 and mounted idly in respective receiving cavities 7 made on the periphery of the body 3.

The diameter of the free ends 8, 9 of each cylinder is reduced to form two shafts for rotation which rotate freely, with mild friction, in the receiving cavities 7, whose shape is complementary accordingly.

The rotating cylinders 4, 5, 6 are removably held in their receiving cavities 7 by means of a lip 10' of an annular ring 10 and a lip 11' of an end cover 11 which are fixed to the body 3 by respective screws 12, 13, 14.

The three cylinders 4, 5, 6 are identical. The only difference is the lengths of their end shafts 8, 9, in order to give them offset longitudinal positions, as will be seen hereinafter.

As is clearly seen in FIG. 3, each of the rotating cylinders is provided with sharp threads 15 which are annular, and therefore not spiral as may be thought. These purely circular threads are all axially separated from one another by a distanced equal to the pitch of the threading to be made.

Their common axis 16 is inclined, with respect to the axis 17 of the tap, by an angle a (FIGS. 1 and 3) which is equal to the helix angle of the threading to be made.

The lengths of the shaft ends 8 and 9 of each rotating cylinder 4, 5, 6 are adjusted so that the threaded parts 15 of each cylinder 4, 5, 6 are offset by a third of pitch from one cylinder to the following over the circumference of the body 3.

In other words, the first annular thread 151 of the second cylinder 6 (FIG. 1) is axially offset, with respect to that of the first cylinder 4, by a third of pitch, and the same applies to the third cylinder 5 with respect to the second cylinder 6.

In addition, in order to allow centering and to begin tapping sufficiently progressively, the diameters of the circles formed by the first edges 151, 152, 153, or leading edges, of each cylinder increase progressively until the diameter effectively necessary for tapping is attained for the fourth edge 154.

As clearly shown in FIG. 2, the cylinders 4, 5, 6 project sufficiently from the peripheral surface 18 of the cylindrical body 3 to fill at that spot the tubular space 19 remaining between this body 3, when it is positioned coaxially with respect to the hole to be tapped, and the threading to be made, with the result that, finally, when the tap rotatingly penetrates in this hole, it makes the threading to the desired pitch d and with the helix angle a, by deformation of matter by the cylinders 4, 5, 6.

It goes without saying that the invention is not limited to the embodiment which has just been described. For example, the cylinders 4, 5, 6 may be held in the body 3 by means other than the ring 10 and the cover 11. Likewise, the number of rotating cylinders may be greater than three. However, it is preferably at least equal to three.

What is claimed is:

1. Tap for making, by deformation of matter, a helicoidal threading inside a hole with smooth walls and of uniformly circular section, comprising a rotatable rigid body whose diameter is smaller over an entire length thereof than that of the hole to be tapped, and which serves as support for a plurality of smaller peripheral rotating cylinders, each having a same diameter and which are regularly spaced apart and mounted idly in a respective peripheral receiving cavity of a plurality of said receiving cavities in said rigid body, wherein said rotating cylinders each rest simply by two respective shaft ends rotatable in said rigid body, said annular threads projecting sufficiently from an outer peripheral surface of said rigid body to fill at that spot the tubular space remaining between said rigid body, positioned coaxially to the hole to be tapped, and the helicoidal threading to be made, a diameter of said peripheral receiving cavities being greater than a diameter of said annular threads so that peripheral walls of said peripheral receiving cavities are respectively spaced apart from an outer edge of said annular threads, said rotating cylinders all being identical, except for the distances between said two respective shaft ends and the annular threads thereof which distances are respectively adjusted so that a first annular thread, or leading thread, of a second cylinder is offset axially with respect to that of a first cylinder, or leading cylinder, by a fraction of pitch equal to the number of cylinders, or by an "Nth" of pitch if the tap comprises N cylinders, and so on, from one cylinder to the following up to the last, or Nth, cylinder of the periphery, each of said rotating cylinders being respectively rotatably held in said peripheral receiving cavities by a lip of an annular ring (10) abutting against a first end of said rigid body and by a lip of an end cover (11) abutting against a second free end said rigid body, wherein said end cover is removably held against said second free end of said rigid body to permit introducing or removing of said rotating cylinders in and out of said peripheral receiving cavities.

2. The tap of claim 1, wherein the edges of the first annular threads of each cylinder are at a distance from the axis of the cylinder which is less than that necessary for making the desired threading, the edge of the first annular thread, or leading thread, in that case being at a distance from this axis which is just sufficient to ensure centering of the tap in the hole to be tapped, while the following thread or threads are at respective distances from this axis which increase progressively until the one necessary for effectively making said threading is finally arrived at.

3. The tap of claim 1, wherein it comprises at least three rotating cylinders.

4. The tap of claim 1 wherein each of the peripheral walls of said peripheral cavities respectively surround at least 180° of said annular threads.

* * * * *